US008544847B2

(12) United States Patent
Emori

(10) Patent No.: US 8,544,847 B2
(45) Date of Patent: Oct. 1, 2013

(54) CARD SHOE APPARATUS ACCURATELY IDENTIFYING CARD INFORMATION OF CARD

(75) Inventor: Kazuki Emori, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 355 days.

(21) Appl. No.: 12/888,955

(22) Filed: Sep. 23, 2010

(65) Prior Publication Data

US 2011/0079956 A1 Apr. 7, 2011

(30) Foreign Application Priority Data

Oct. 2, 2009 (JP) ..... 2009-230766

(51) Int. Cl.
*A63F 1/12* (2006.01)

(52) U.S. Cl.
USPC ..... 273/149 R

(58) Field of Classification Search
None
See application file for complete search history.

(56) References Cited

U.S. PATENT DOCUMENTS 5,356,145 A 10/1994 Verschoor
5,362,053 A 11/1994 Miller
5,470,079 A 11/1995 LeStrange et al.
5,586,766 A 12/1996 Forte et al.
5,586,936 A 12/1996 Bennett et al.
5,613,912 A 3/1997 Slater
5,669,816 A 9/1997 Garczynski et al.
5,722,893 A 3/1998 Hill et al.
5,941,769 A 8/1999 Order
6,039,650 A * 3/2000 Hill ..... 463/47
6,299,536 B1 * 10/2001 Hill ..... 463/47
6,638,161 B2 * 10/2003 Soltys et al. ..... 463/12
7,114,718 B2 * 10/2006 Grauzer et al. ..... 273/149 R
7,407,438 B2 8/2008 Schubert et al.
7,593,544 B2 * 9/2009 Downs et al. ..... 382/100
7,942,418 B2 * 5/2011 Amaitis et al. ..... 273/292
2011/0127722 A1 * 6/2011 Emori et al. ..... 273/274

* cited by examiner

*Primary Examiner* — Kurt Fernstrom
*Assistant Examiner* — Dolores Collins
(74) *Attorney, Agent, or Firm* — Edwards Wildman Palmer LLP

(57) ABSTRACT

The following members are included: a storage unit 2 which stores a card 50; a guide path 10 which guides the card 50 drawn out from the storage unit 2 to a card discharging edge 18 while keeping one surface of the card 50 to contact the guide path 10; an opening 13 which is formed in the guide path 10; an inspection light applicator 31 which applies inspection light to the drawn card via the opening 13; a photo acceptance portion 32 which receives the inspection light reflected from the drawn card 50; a control unit 151 which identifies card information based on the inspection light received by the photo acceptance portion 32; and a filter 34 which is provided between the opening 13 and the photo acceptance portion 32 to block the disturbance light.

4 Claims, 12 Drawing Sheets

CARD SHOE APPARATUS ACCURATELY IDENTIFYING CARD INFORMATION OF CARD

CROSS REFERENCE TO RELATED APPLICATION

The present application claims priority from Japanese application No. 2009-230766, which was filed on Oct. 2, 2009, the entire disclosure of which is herein incorporated by reference.

BACKGROUND OF THE INVENTION

1. Field of the Invention

The present invention relates to a card shoe apparatus which identifies the card information of cards.

2. Description of Related Art

In casinos where table card games such as blackjack are playable, each game table is typically provided with a card shoe apparatus, and cards distributed to players are fetched from such a card shoe apparatus. There are known card shoe apparatuses which identify the card information of fetched cards by means of inspection light such as infrared laser, as described in the specification of U.S. Pat. No. 7,407,438, the specification of U.S. Pat. No. 5,356,145, the specification of U.S. Pat. No. 5,362,053, the specification of U.S. Pat. No. 5,470,079, the specification of U.S. Pat. No. 5,586,766, the specification of U.S. Pat. No. 5,586,936, the specification of U.S. Pat. No. 5,613,912, the specification of U.S. Pat. No. 5,669,816, the specification of U.S. Pat. No. 5,722,893, the specification of U.S. Pat. No. 5,941,769, and the specification of U.S. Pat. No. 6,039,650.

In such card shoe apparatuses, however, the identification of the card information of cards by means of inspection light such as infrared laser as described above is disadvantageous in that the identification accuracy is deteriorated on account of disturbance light such as illumination.

The present invention was done to solve the problem above, and an object of the present invention is to provide a card shoe apparatus which is able to accurately identify the card information of cards.

SUMMARY OF THE INVENTION

A card shoe apparatus of the present invention includes: a storage unit which stores a card; a guide path which guides the card drawn out from the storage unit to a card discharging edge while keeping one surface of the card to contact the guide path; an opening which is formed in the guide path; an inspection light applicator which applies inspection light to the drawn card via the opening; a photo acceptance portion which receives the inspection light reflected from the drawn card; a card information identification unit which identifies card information based on the inspection light received by the photo acceptance portion; and a filter which is provided between the opening and the photo acceptance portion to block the disturbance light.

According to this arrangement, the filter for blocking the disturbance light is provided between the opening and the photo acceptance portion. This allows the photo acceptance portion to receive only the inspection light reflected from the drawn card without being influenced by the disturbance light, thereby making it possible to accurately identify the card information.

In addition to the above, the card shoe apparatus of the present invention may be arranged so that the filter is arranged to be detachable. According to this arrangement, it is possible to change the filter in accordance with the intensity of the disturbance light because the filter is arranged to be detachable. Since a filter suitable for the intensity of the disturbance light is attachable, it is possible to accurately identify the card information.

In addition to the above, the card shoe apparatus of the present invention may further include a moving unit which moves the drawn card in the guide path at a speed which allows the card information identification unit to identify the card information. According to this arrangement, since the drawn card moves in the opening at a speed which allows the card information identification unit to identify the card information, it is possible to accurately identify the card information.

In addition to the above, the card shoe apparatus of the present invention may be arranged so that the moving unit moves the drawn card at a constant speed in the guide path. According to this arrangement, the drawn card moves at a constant speed in the guide path. This makes it possible to restrain the accuracy of identification of the card information from being lowered on account of a change in the traveling speed of the drawn card in the guide path.

DESCRIPTION OF THE PREFERRED EMBODIMENTS (First Embodiment)

A card shoe apparatus of First Embodiment according to the present invention will be described with reference to FIG. 1 to FIG. 7. It is noted that the external shape of the card shoe apparatus 1 is identical with those of substantially typical conventional card shoe apparatuses.

Figure 1:
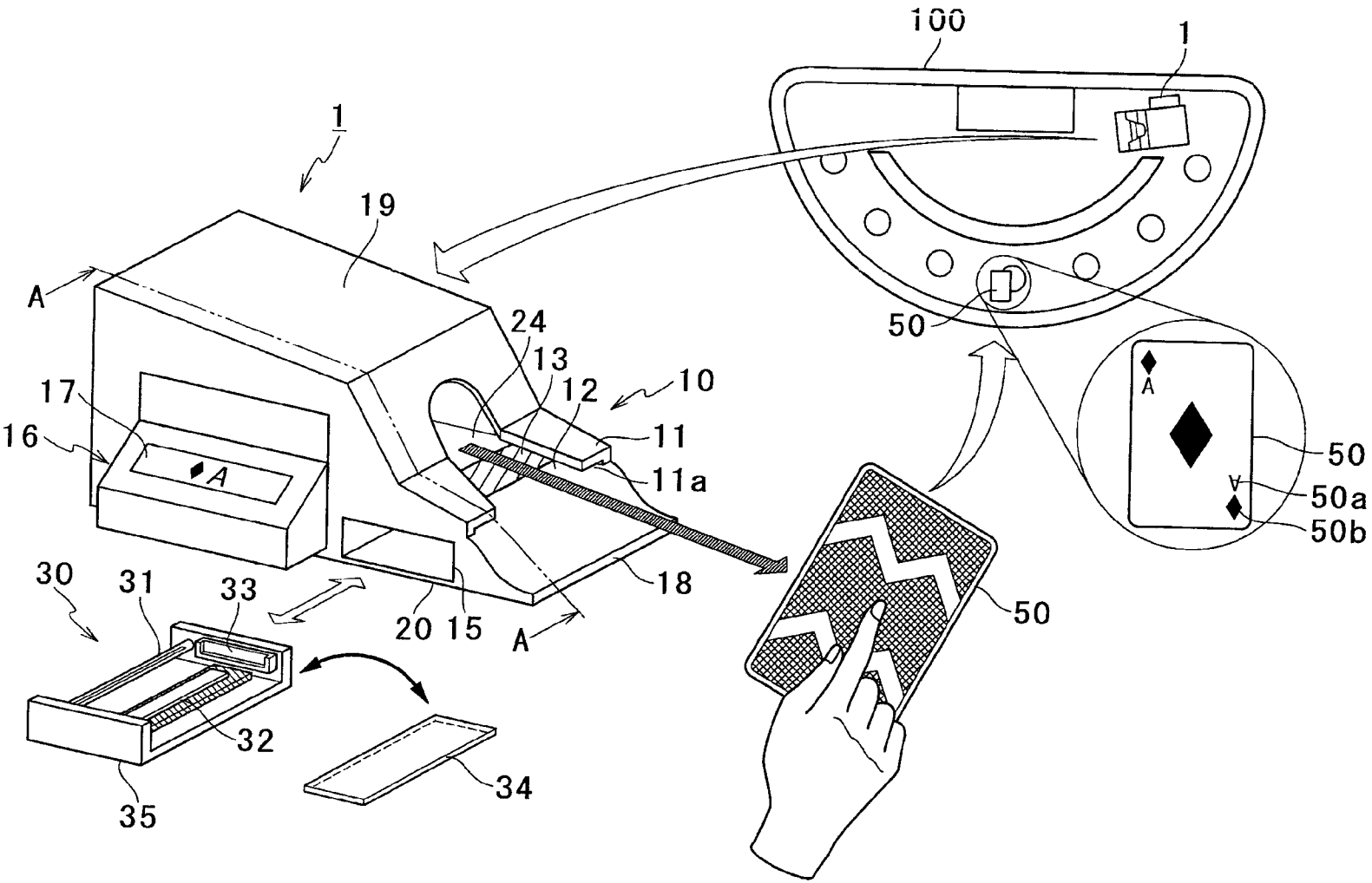
FIG. 1 illustrates a card shoe apparatus of First Embodiment according to the present invention.
Figure 2:
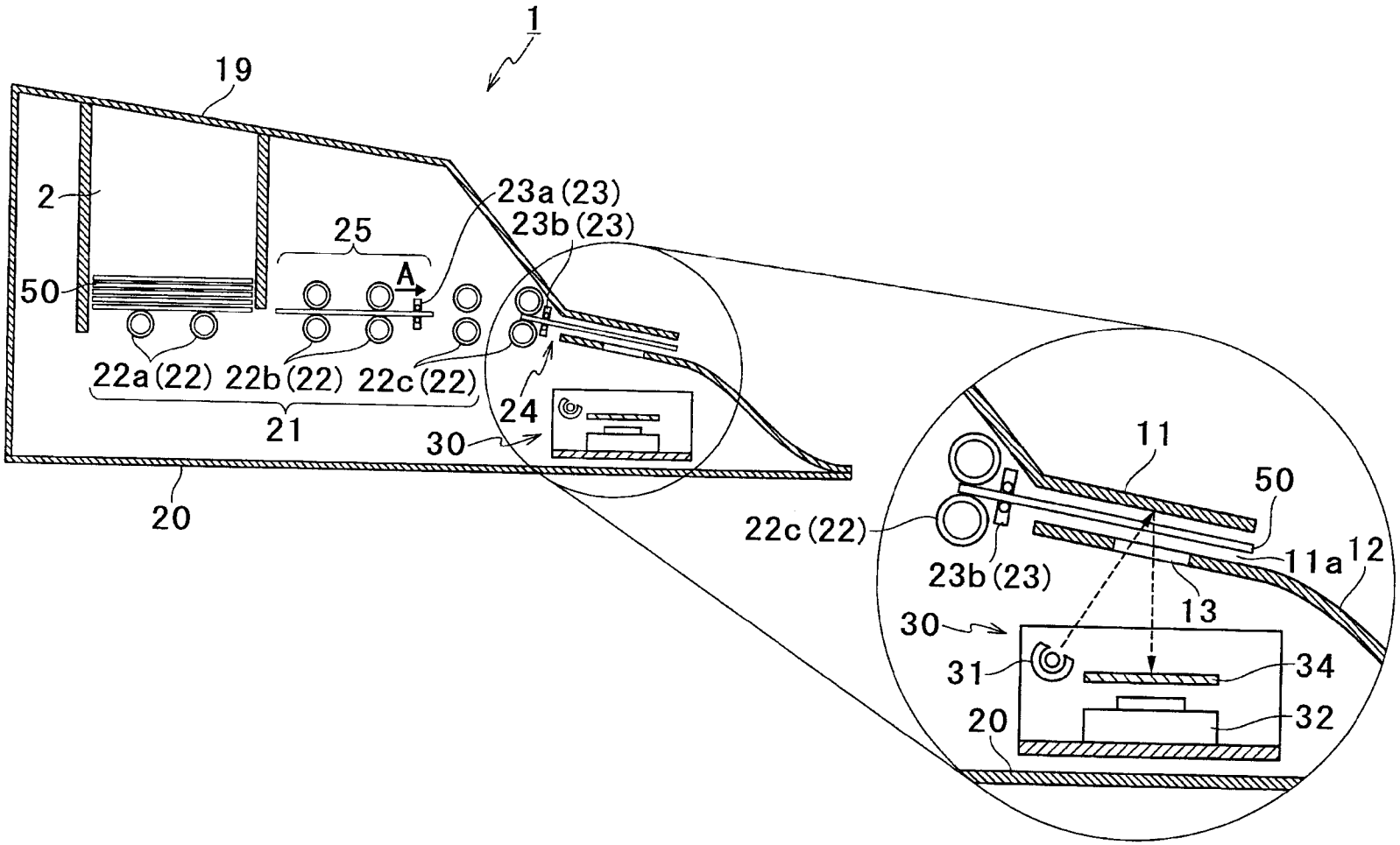
FIG. 2 is a cross section taken along the line A-A in FIG. 1.

FIG. 1 illustrates the card shoe apparatus of First Embodiment. FIG. 2 is a cross section taken along the A-A line in FIG. 1.

As shown in FIG. 1, the card shoe apparatus 1 is mounted on a game table 100 in a casino or the like.

As shown in FIG. 1 and FIG. 2, the card shoe apparatus 1 includes a cover portion 19, a bottom portion 20, a storage unit 2 storing a card 50, a guide path 10 by which the card 50 drawn from the storage unit 2 is guided to a card discharging edge 18, a detector unit 30, and a display unit 16. The cover portion 19 is attached to the bottom portion 20 to cover a conveyance mechanism 21 which will be described later and a control board 150, in addition to the storage unit 2.

The storage unit 2 stores stacked cards 50. The cards 50 stored in the storage unit 2 are stacked face down. The storage unit 2 is provided with a unillustrated card quantity sensor 27 which detects the quantity of the cards 50 stored in the storage unit 2.

As shown in FIG. 1, the guide path 10 has a card guide surface 12. This card guide surface 12 is a slanted surface connecting a later-described conveyance end edge 24 with the card discharging edge 18. In addition to this, the card guide surface 12 has an opening 13 which is slightly wider than the long sides of the card 50. At the respective edges of the card guide surface 12, guide rails 11 are formed to provide a guide groove 11*a*. The depth of the guide groove 11*a* formed by the guide rails 11 is arranged to be slightly longer than the thickness of a single card 50. Alternatively, a transparent plate made of glass or the like may be fitted into the opening 13.

By the card guide surface 12 and the guide rails 11, a card 50 provided at the conveyance end edge 24 is guided to the card discharging edge 18 with one surface of the card contacting the card guide surface 12. It is noted that a card 50 is moved from the conveyance end edge 24 to the card discharging edge 18 by hand (i.e. the dealer). The guide path 10 is further provided with an unillustrated traveling speed sensor 26 to detect the traveling speed of a card 50 moving in the guide path 10.

At a side wall of the cover portion 19, an insertion slot 15 is formed to receive the detector unit 30. As the detector unit 30 is inserted into the insertion slot 15, the detector unit 30 is connected to a later-described control board 150 so as to allow data communication therebetween.

Figure 3:
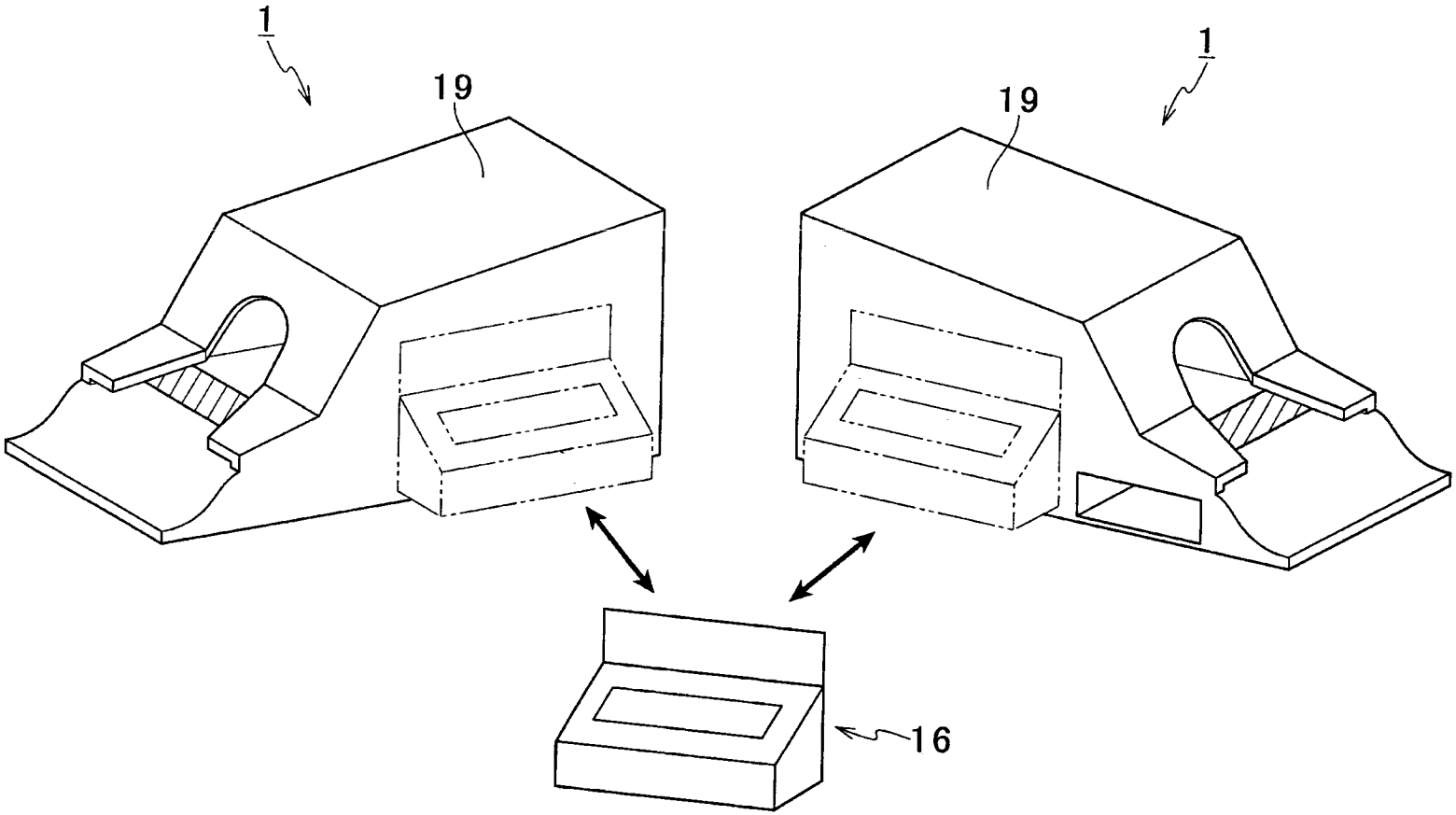
FIG. 3 illustrates the mounting position of a display unit of the card shoe apparatus of First Embodiment according to the present invention.

On both side walls of the cover portion 19, unillustrated hooks are formed. The display unit 16 has an unillustrated tongue portion which can be engaged with a hook of the cover portion 19. With this arrangement, as shown in FIG. 3, the display unit 16 is attachable to either side of the cover portion 19. This makes it possible to change the mounting position of the display unit 16 in accordance with the better arm of a dealer.

The display unit 16 has a display 17. The display 17 displays card information identified by a later-described card information identification unit (control unit) 151.

The card information is, as shown in FIG. 1, constituted by text information 50*a* and symbol information 50*b* of a card 50, and is unique to each card. There are 13 types of text information 50*a*, namely numbers from 2 to 10, J (JACK), Q (QUEEN), K (KING), and A (ACE). On the other hand, there are four types of symbol information 50*b*, namely heart, diamond, club, and spade.

The detector unit 30 is provided with an inspection light applicator 31, a photo acceptance portion 32, filter supporters 33, a filter 34, and a housing unit 35 in which the members 31 to 34 are housed. The inspection light applicator 31 outputs infrared linear light toward the opening 13. The infrared linear light output from the inspection light applicator 31 is projected via the opening 13 to the card 50 being moved on the guide path 10 by hand so that the card 50 is scanned by the light along its long sides.

The photo acceptance portion 32 has plural pixels receiving reflected infrared light from the card 50, and the pixels are aligned in row in parallel to the long sides of the card 50 being moved in the guide path 10.

Opposing side walls of the housing unit 35 are provided respectively with filter supporters 33 which support the filter 34 in a detachable manner. The filter 34 is a visible light filter which blocks visible light. The filter 34 is supported by the pair of filter supporters 33 so as to be provided between the opening 13 and the photo acceptance portion 32, with the result that an amount of visible light received by the photo acceptance portion 32 is reduced.

As such, the filter 34 is arranged to be detachable to the filter supporter 33, and hence a suitable filter is attachable in accordance with the intensity of disturbance light.

As shown in FIG. 2, a card 50 stored in the storage unit 2 is conveyed along the path A to the conveyance end edge 24 via a standby position 25 by the conveyance mechanism 21. The conveyance mechanism 21 has conveyance rollers 22 and card sensors 23. The rotation of the conveyance rollers 22 is controlled by a later-described actuator driving unit 156.

The conveyance rollers 22 are constituted by drawing rollers 22*a*, first-stage guide rollers 22*b*, and second-stage guide rollers 22*c*. The drawing rollers 22*a* draw one card 50 from the storage unit 2 and convey it to the standby position 25. The first-stage guide rollers 22*b* convey the card 50 drawn by the drawing rollers 22*a* to the standby position 25 and further convey the card 50 from the standby position 25 to the conveyance end edge 24. The second-stage guide rollers 22*c* convey the card 50 from the standby position 25 to the conveyance end edge 24.

The card sensors 23 are provided at arbitrary positions along the path A, so as to detect the existence of a card 50 and the movement of the card 50. In the present embodiment, the card sensors 23 are provided at the standby position 25 and at the conveyance end edge 24, respectively.

When the card sensor 23*b* provided at the conveyance end edge 24 does not detect the existence of a card 50, the actuator driving unit 156 rotates the first-stage guide rollers 22*b* and the second-stage guide rollers 22*c* until the card sensor 23*b* detects the existence of a card.

When the card sensor 23*a* provided at the standby position 25 does not detect the existence of a card 50, the actuator driving unit 156 rotates the drawing rollers 22*a* and the first-stage guide rollers 22*b* until the card sensor 23*a* detects the existence of a card 50.

(Electric Configuration of Card Shoe Apparatus 1)

Now, the electric configuration of the card shoe apparatus 1 of First Embodiment will be described with reference to FIG. 4.

Figure 4:
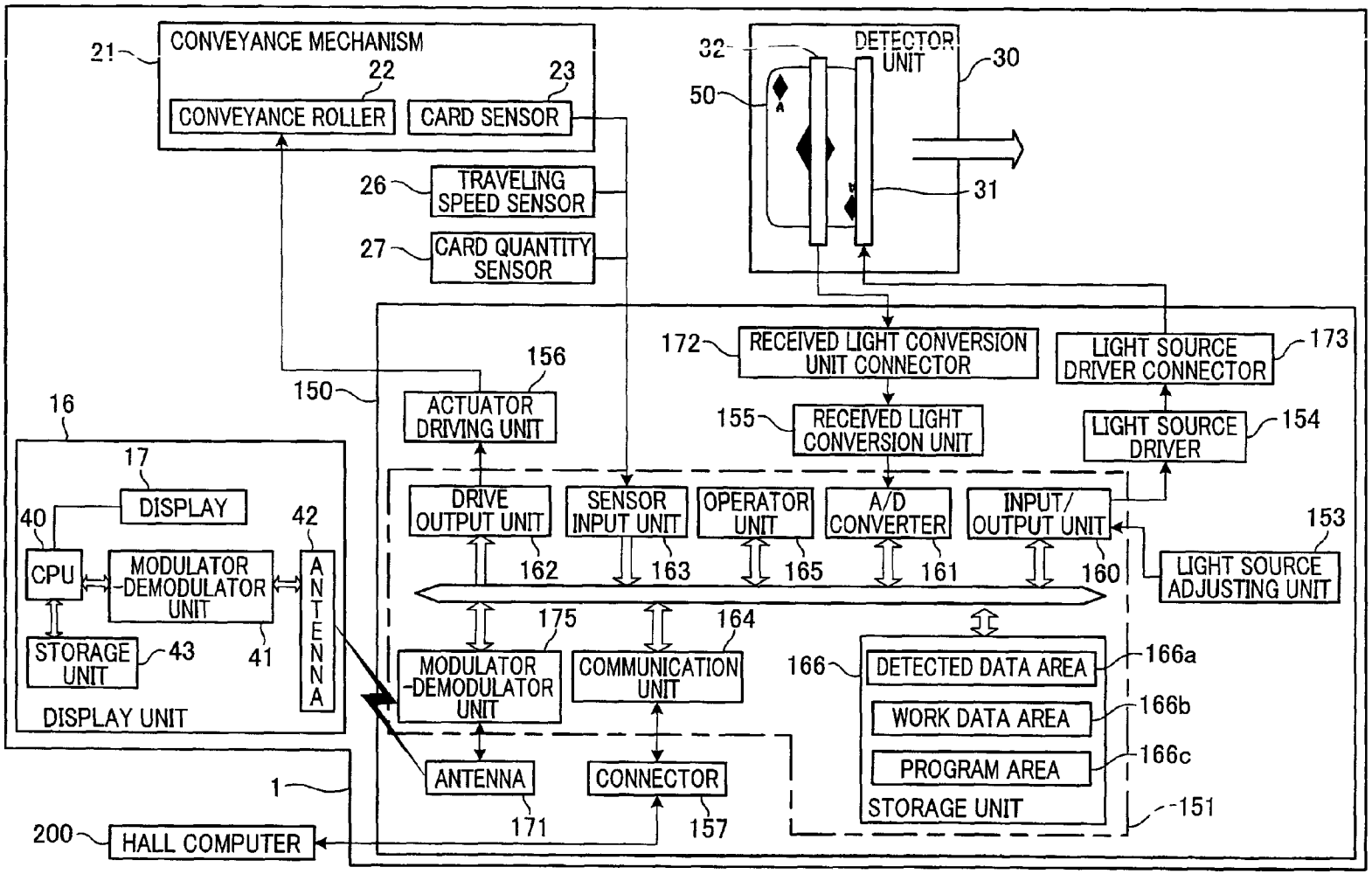
FIG. 4 shows the electric configuration of the card shoe apparatus of First Embodiment according to the present invention.

The card shoe apparatus 1 includes, as shown in FIG. 4, a control board 150, a detector unit 30 detachable to the control board 150, and a display unit 16 connected to the control board 150 so as to allow data communication therebetween.

The control board 150 is connected to the control unit 151 constituted by a micro computer or the like, a light source adjusting unit 153 which adjusts an amount of infrared linear light output from the inspection light applicator 31 of the detector unit 30, a light source driver 154 which causes the inspection light applicator 31 of the detector unit 30 to output infrared linear light, a received light conversion unit 155 which converts the light amount detected by the photo acceptance portion 32 of the detector unit 30 into an analog electric signal, an actuator driving unit 156 which rotates the conveyance rollers 22, a connector 157, and an antenna 171. The light source driver 154 causes the inspection light applicator 31 to output infrared linear light when the card sensor 23*b* provided at the conveyance end edge 24 detects the movement of a card 50.

The control unit 151 includes an input/output unit 160, an analog-digital (A/D) converter 161, a drive output unit 162, a sensor input unit 163, a communication unit 164, an operator unit 165, and a storage unit 166.

The input/output unit 160 is connected to the aforesaid light source driver 154 and light source adjusting unit 153. The input/output unit 160 makes it possible to convert a signal and data input from the light source adjusting unit 153 into a format suitable for information processing in the control unit 151. Furthermore, the input/output unit 160 outputs a signal supplied from the control unit 151 to the light source driver 154.

The received light conversion unit 155 converts the gray-scale information of a card 50, which indicates an amount of light received by each pixel of the photo acceptance portion 32 in each predetermined time, into an analog electric signal (i.e. performs photoelectric conversion), and serially outputs the analog signals to the A/D converter 161.

The A/D converter 161 converts analog values of pixels belonging to a single line, which values are output from the received light conversion unit 155, into digital data, and outputs the digital data to the detected data area 166*a* of the storage unit 166. More specifically, the A/D converter 161 converts analog values into binary values of 0 and 1 in accordance with a predetermined threshold. As a result, a card 50 is divided into a background area and feature areas including symbol information 50*b* and text information 50*a*. In the present embodiment, an analog value is converted by the A/D converter 161 so that feature areas correspond to "1" whereas background areas correspond to "0".

In addition to the above, the drive output unit 162 is connected to the actuator driving unit 156, and is arranged to be able to rotate the conveyance rollers 22 by the actuator driving unit 156. The sensor input unit 163 is connected to the card sensor 23, the traveling speed sensor 26, and the card quantity sensor 27, and allows signals from these sensors to be converted to have formats suitable for information processing in the control unit 151 and to be fetched.

The storage unit 166 has a detected data area 166*a*, a work data area 166*b*, and a program area 166*c*. The detected data area 166*a* is used for temporarily storing, as detected data, digital data output from the A/D converter 161. The work data area 166*b* is where the detected data in the detected data area 166*a* is transferred, and is used for identification processing for identifying card information based on the detected data. The program area 166*c* stores various programs such as an identification process routine and various types of data such as a template of card information, in readable and rewritable manners. The program area 166*c* may be alternatively arranged to be non-rewritable.

The operator unit 165 is arranged to be able to run various programs such as the aforesaid identification process routine, and to be able to identify the card information of a card 50. In addition, the operator unit 165 corrects the detected data so that the aspect ratio of the area indicating the card 50 in the detected data is identical with the actual aspect ratio of the card 50, in accordance with the traveling speed of the card 50 detected by the traveling speed sensor 26.

The communication unit 164 is connected to a hall computer 200 via a connector 157 so as to allow data communication therebetween, and outputs, to the hall computer 200, a card information signal indicating the card information identified by the operator unit 165. In addition to this, the communication unit 164 outputs, to the hall computer 200, a card refill signal which instructs the refilling of the cards 50 when the card quantity sensor 27 detects that the number of the cards 50 stored in the storage unit 2 becomes equal to or lower than a predetermined number.

A modulator-demodulator unit 175 is connected to the antenna 171. The modulator-demodulator unit 175 has a modulation function to convert data from a signal format suitable for information processing in the control unit 151 to a signal format suitable for data communication via the antenna 171 and a demodulation function to convert the signal format suitable for data communication to the signal format for information processing in the control unit 151.

The card refill signal and a card information signal indicating the card information identified by the operator unit 165 are output to the modulator-demodulator unit 175 and to the display unit 16 via the antenna 171.

The detector unit 30 includes the inspection light applicator 31 and the photo acceptance portion 32. The inspection light applicator 31 is detachably connected to the light source driver 154 via a light source driver connector 173. The photo acceptance portion 32 is detachably connected to the received light conversion unit 155 via a received light conversion unit connector 172.

The display unit 16 includes a display 17, a CPU 40 performing control operations in accordance with a predetermined program, a modulator-demodulator unit 41, an antenna 42, and a storage unit 43.

The modulator-demodulator unit 41 is connected to the antenna 42. The modulator-demodulator unit 41 has a modulation function to convert data from a signal format suitable for information processing in the CPU 40 to a signal format suitable for data communication via the antenna 42 and a demodulation function to convert the signal format suitable for data communication to the signal format for information processing in the CPU 40.

The storage unit 43 stores various types of data such as a card information correspondence table of card information signals and display images of card information displayed on the display 17. When receiving a card information signal via the antenna 42 and the modulator-demodulator unit 41, the CPU 40 refers to the card information correspondence table and displays on the display 17 the card information indicated by the card information signal to allow the dealer to identify the card information. Furthermore, when receiving a card refill signal via the antenna 42 and the modulator-demodulator unit 41, the CPU 40 displays on the display 17 an image which urges the dealer to refill the cards 50.

(Operation of Card Shoe Apparatus 1)

Now, the operation of the card shoe apparatus 1 will be described. When no card 50 exists at the conveyance end edge 24, the conveyance mechanism 21 conveys a card 50 from the storage unit 2 to the conveyance end edge 24. As the dealer moves the card 50 at the conveyance end edge 24 in the guide path 10 to the direction in parallel to the short sides of the card 50, the card sensor 23*b* detects the movement of the card 50, and the light source driver 154 drives the inspection light applicator 31 so that infrared linear light is applied from the inspection light applicator 31 towards the opening 13. At the same time, the traveling speed sensor 26 detects the traveling speed of the card 50 moving in the guide path 10.

The infrared linear light output from the inspection light applicator 31 passes through the opening 13 and is projected to the card 50 moving in the guide path 10 so that the card 50 is scanned by the light along its long sides (i.e. projected to an area equivalent to one line). The infrared linear light reflected from the card 50 passes through the opening 13 and is received via the filter 34 by pixels aligned to form rows on the photo acceptance portion 32.

The intensity of the light reflected from the card 50, which light has been received by each pixel of the photo acceptance portion 32, is converted to an analog electric signal by the received light conversion unit 155, in each predetermined time. The analog values each for one line and having been converted within each predetermined time are serially output to the A/D converter 161 along the long sides of the card 50.

The analog value for one line, which is output from the received light conversion unit 155, is converted to digital data by the A/D converter 161, and is temporarily stored as detected data for one line in the detected data area 166*a* of the storage unit 166.

Since the card 50 has been moved by the dealer in the direction in parallel to the short sides of the card 50, a light application position on the card, where the infrared linear light scans along the long sides of the card 50 (i.e. an area for one line), is also moved in the direction in parallel to the short sides of the card. As such, two-dimensional image information of the card 50 is obtained by repeatedly obtaining detected data along the long sides of the card 50 (i.e. data for one line), that is, by repeatedly obtaining one-dimensional image information of the card 50.

The detected data temporarily stored in the detected data area 166*a* is transferred to the work data area 166*b*, and the operator unit 165 identifies the card information of the detected data.

The card information representing the card information identified by the operator unit 165 is output to the hall computer 200 and the display unit 16. The display 17 of the display unit 16 displays the card information represented by the received card information signal.

(Detected Data)

Figure 5:
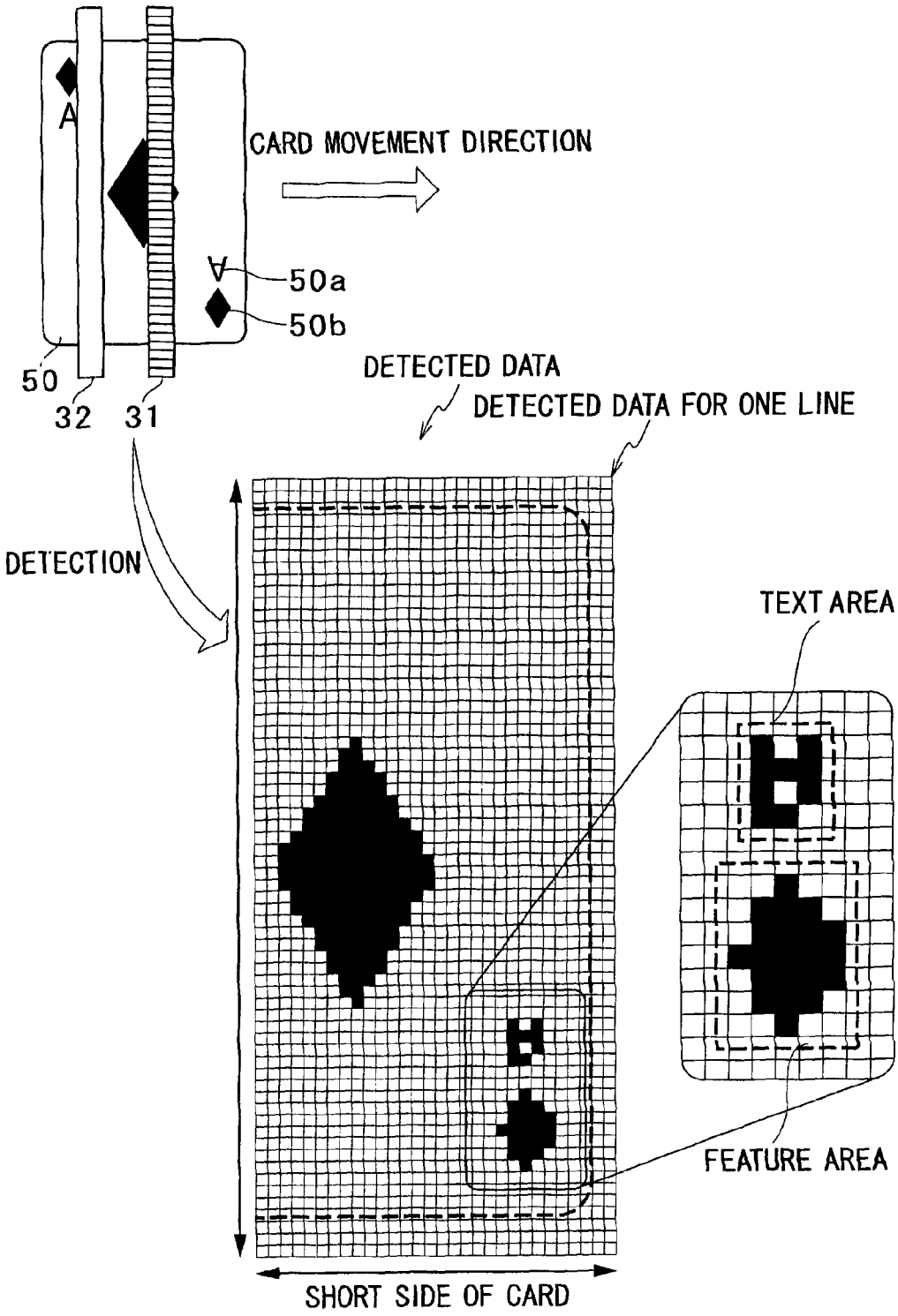
FIG. 5 shows detected data of the card shoe apparatus of First Embodiment according to the present invention.

Referring to FIG. 5, the detected data will be described. It is noted that the detected data shown in FIG. 5 is data which has been corrected so that the aspect ratio of the area representing a card 50 in the data is identical with the actual aspect ratio of the card 50 in accordance with the traveling speed of the card 50 detected by the traveling speed sensor 26.

The vertical directions of the detected data in FIG. 5 correspond to the directions of the long sides of the card 50, whereas the horizontal directions correspond to the directions of the short sides of the card. The squares in the figure indicate the detected pixels. The detected pixels in black are those converted to "1" by the A/D converter 161, i.e. are parts of a feature area. On the other hand, the detected pixels in white are those converted to "0" by the A/D converter 161, i.e. are parts of a background area.

In the identification process routine, a text area and a symbol area are sampled from a feature area of the detected data, and text information 50*a* of a card 50 is identified in the text area and symbol information 50*b* of the card 50 is identified in the symbol area, with reference to templates of card information stored in the storage unit 166. Then, based on the identified text information 50*a* and symbol information 50*b*, the card information of the card 50 is identified.

In the present embodiment, detected data is obtained along the long sides of a card 50. The present invention, however, is not limited to this arrangement, and detected data may only be obtained from an area where text information 50*a* and/or symbol information 50*b* is identified in a card 50.

(Main Process Routine)

Figure 6:
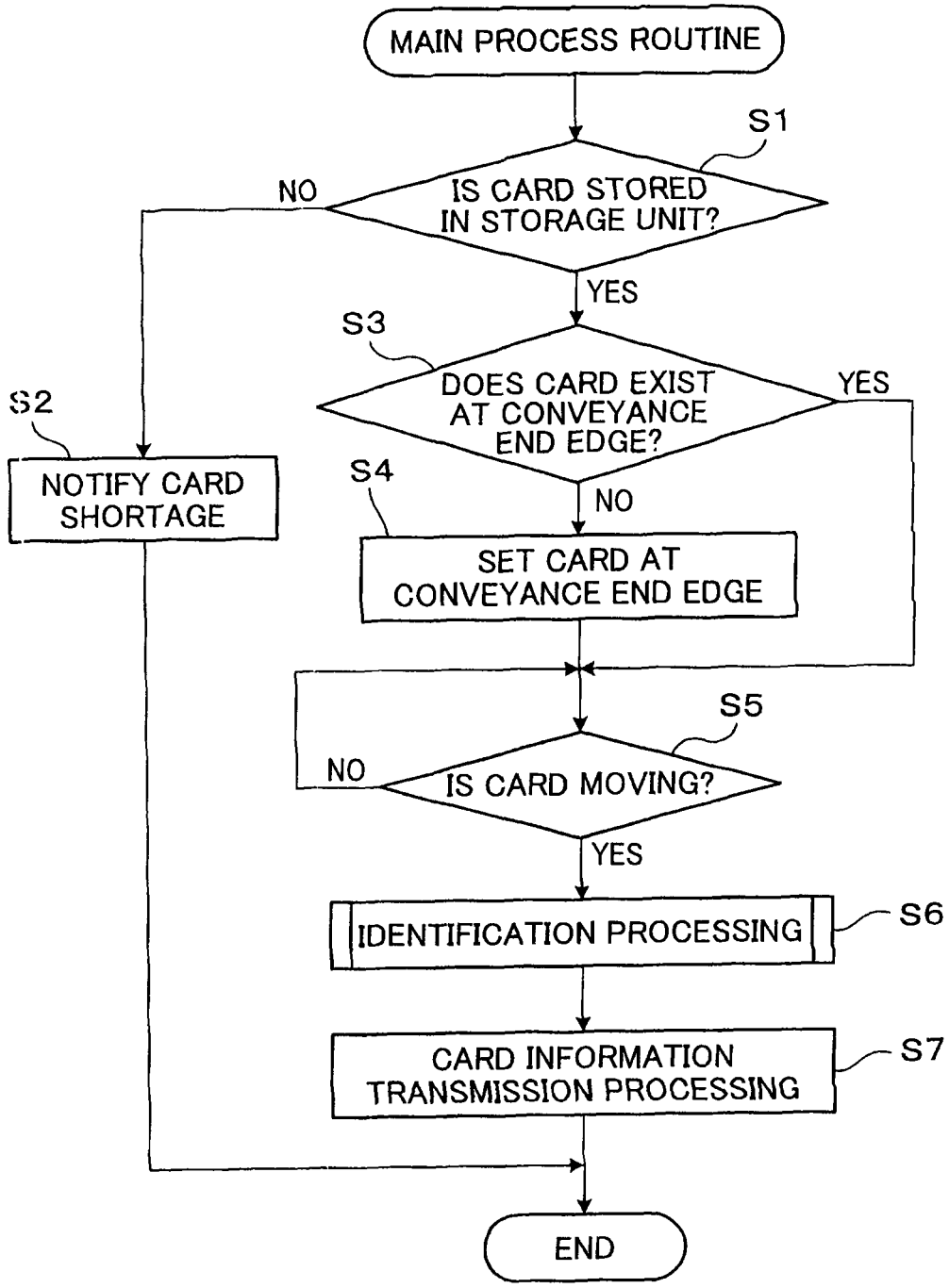
FIG. 6 is a flowchart of a main process routine of First Embodiment according to the present invention.

Now, the main process routine of the card shoe apparatus 1 according to First Embodiment will be described. FIG. 6 is a flowchart of the main process routine of the card shoe apparatus 1 according to First Embodiment.

First, the control unit 151 determines whether at least a predetermined number of cards are stored in the storage unit 2 by the card quantity sensor 27 (S1). When the predetermined number or more cards are not stored according to the determination (S1: NO), a card refill signal is output to the display unit 16 and the hall computer 200 so as to notify the dealer and hall administrator that the predetermined number or more of cards are not stored (S2), and the process routine is terminated.

On the other hand, if the predetermined number or more of cards are stored according to the determination (S1: YES), the control unit 151 checks whether a card 50 exists at the conveyance end edge 24 (S3). When it is determined that a card 50 exists at the conveyance end edge 24 (S3: YES), the process proceeds to S5. On the other hand, if it is determined that no card exists at the conveyance end edge 24 (S3: NO), the conveyance mechanism 21 conveys a card 50 from the storage unit 2 to the conveyance end edge 24 (S4), and the process proceeds to S5.

In S5, the control unit 151 determines whether the card sensor 23*b* has detected the movement of the card 50. If it is determined that the movement of the card 50 has not been detected (S5: NO), the process goes back to S5. On the other hand, if it is determined that the movement of the card 50 has been detected (S5: YES), the control unit 151 carries out identification processing which will be described later with reference to FIG. 7 (S6).

Subsequently, the control unit 151 carries out card information transmission processing to output a card information signal representing the card information of the card 50 identified in the identification processing in S6 to the display unit 16 and the hall computer 200 (S7), and then the process routine is finished.

(Identification Process Routine)

Figure 7:
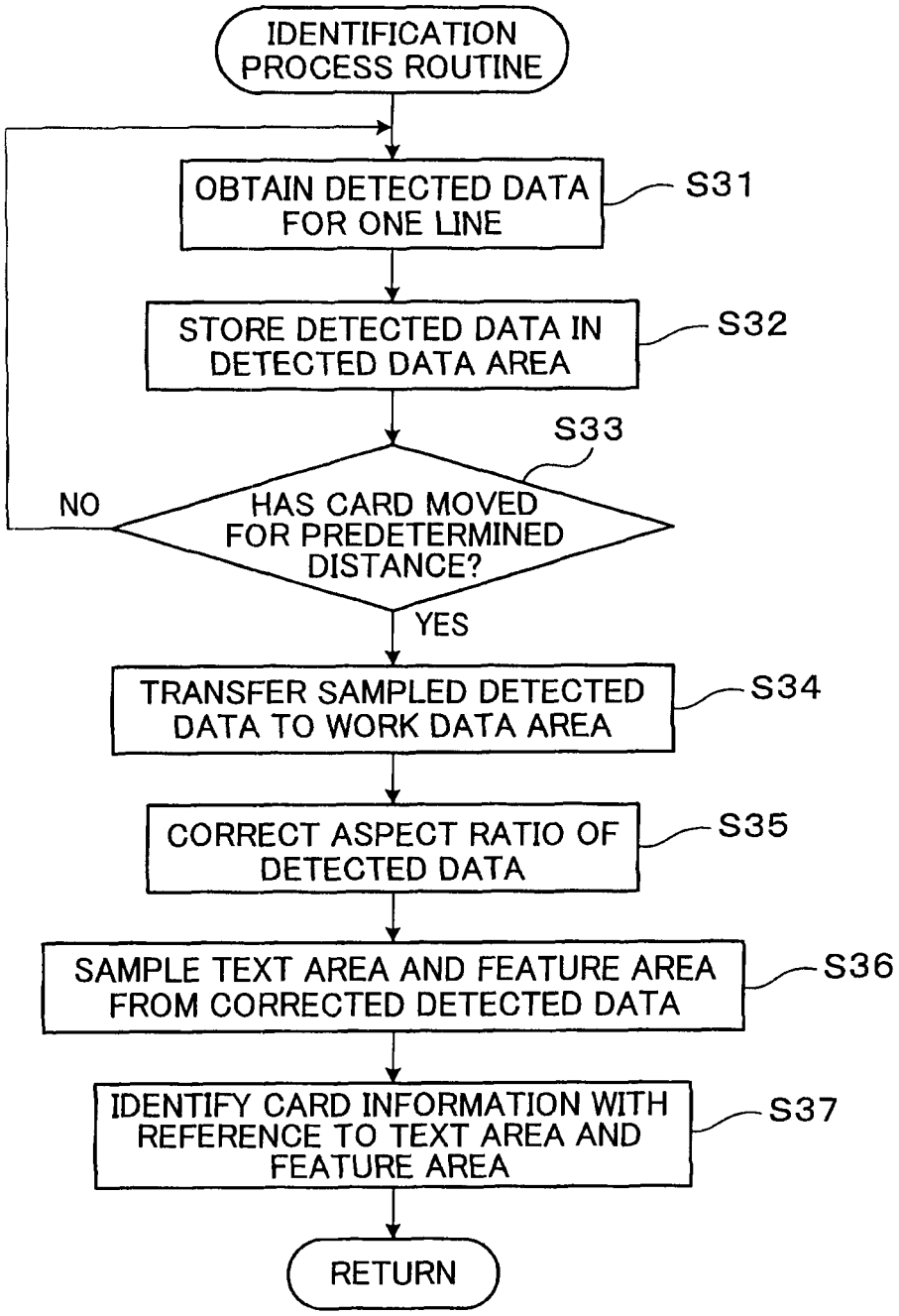
FIG. 7 is a flowchart of an identification process routine of First Embodiment according to the present invention.

Now, the identification process routine of the card shoe apparatus 1 according to First Embodiment will be described. FIG. 7 is a flowchart of the identification process routine of the card shoe apparatus 1 according to First Embodiment.

First, the control unit 151 obtains detected data for one line (S31), and stores the detected data in the detected data area 166*a* (S32). Subsequently, the control unit 151 determines, by the traveling speed sensor 26, whether the card 50 has moved by a predetermined distance in the guide path 10 (S33). If it is determined that the card has not moved by the predetermined distance (S33: NO), the process goes back to S31. On the other hand, if it is determined that the card has moved by the predetermined distance (S33: YES), the detected data stored in the detected data area 166*a* is transferred to the work data area 166*b* (S34).

Thereafter, the control unit 151 corrects the detected data stored in the work data area 166*b* (S35). More specifically, based on the traveling speed of the card 50 detected by the traveling speed sensor 26, the correction is carried out so that the aspect ratio of the area representing the card 50 in the detected data is identical with the actual aspect ratio of the card 50.

Subsequently, the control unit 151 samples a text area and a symbol area from the corrected detected data (S6), so as to identify the card information (S37). More specifically, with reference to templates of card information stored in the storage unit 166, text information 50*a* of the card 50 is identified in the text area and symbol information 50*b* of the card 50 is identified in the symbol area. Based on the identified text information 50*a* and symbol information 50*b*, the card information of the card 50 is identified. After S37, the process routine is finished.

(Outline of First Embodiment)

As described above, a card shoe apparatus 1 according to First Embodiment includes a storage unit 2 storing cards 50, a guide path 10 which guides a card 50 drawn out from the storage unit 2 to a card discharging edge 18 with one surface of the card kept contacting the guide path 10, an opening 13 formed in the guide path 10, an inspection light applicator 31 which applies inspection light to the drawn card 50 via the opening 13, a photo acceptance portion 32 which receives inspection light reflected from the drawn card 50, a card information identification unit (control unit) 151 which identifies the card information based on the inspection light received by the photo acceptance portion 32, and a filter 34 which is provided between the opening 13 and the photo acceptance portion 32 to block disturbance light.

According to the arrangement above, the filter 34 is provided between the opening 13 and the photo acceptance portion 32 to block disturbance light. This allows the photo acceptance portion 32 to receive only the inspection light reflected from the drawn card 50 without being influenced by the disturbance light, thereby making it possible to accurately identify the card information.

In addition to the above, the card shoe apparatus 1 according to First Embodiment is arranged so that the filter 34 is detachable. Since the filter 34 is detachable, it is possible to change a filter in accordance with the intensity of disturbance light. Since a filter 34 suitable for the intensity of the disturbance light is attachable, it is possible to accurately identify the card information.

While the present invention has been described in conjunction with First Embodiment outlined above, it is evident that many alternatives, modifications and variations will be apparent to those skilled in the art. Accordingly, the effects of First Embodiment of the invention as set forth above are merely listed as most favorable effects of the invention, and hence the effects of the invention are not limited to those in First Embodiment.

For example, First Embodiment of the present invention is arranged so that the filter 34 is provided between the opening 13 and the photo acceptance portion 32 as the filter 34 is supported by the filter supporters 33. Alternatively, the filter 34 may be disposed between the opening 13 and the photo acceptance portion 32 by detachably attaching the filter 34 onto the top surface of the photo acceptance portion 32.

(Second Embodiment)

Second Embodiment according to the present invention will be described with reference to FIGS. 8-12. It is noted that the same reference numerals are assigned to components having substantially identical arrangements as those of First Embodiment and the descriptions thereof are omitted. Second Embodiment is different from First Embodiment in the following points.

A card shoe apparatus of Second Embodiment includes, in the guide path, a moving unit which moves a card at a constant speed with which the control unit is able to identify the card information. Furthermore, the card shoe apparatus of Second Embodiment does not include the conveyance mechanism, and cards stored in the storage unit are manually drawn out. Moreover, Second Embodiment is arranged so that barcodes are printed at the respective short sides of each card, thereby allowing the card shoe apparatus to recognize the barcodes so that the card information is identified based on the result of the recognition.

This embodiment was created because the conventional approaches involve a disadvantage in that, in an identification apparatus which obtains the image information of an identification target and identifies a text or the like in the image information, the accuracy of identification of a text or the like is low because the obtained image information is elongated and/or contracted as the identification target is moved at varied traveling speeds.

In the card shoe apparatus 1, when the detected image of a card 50 being manually moved is obtained, the accuracy of identification of the card information may be low because the detected image is elongated and/or contracted.

Second Embodiment was invented to solve the problem above, and an objective thereof is to restrain the accuracy of identification of card information from being lowered due to a change in the traveling speed of a drawn card in the guide path.

Figure 8:
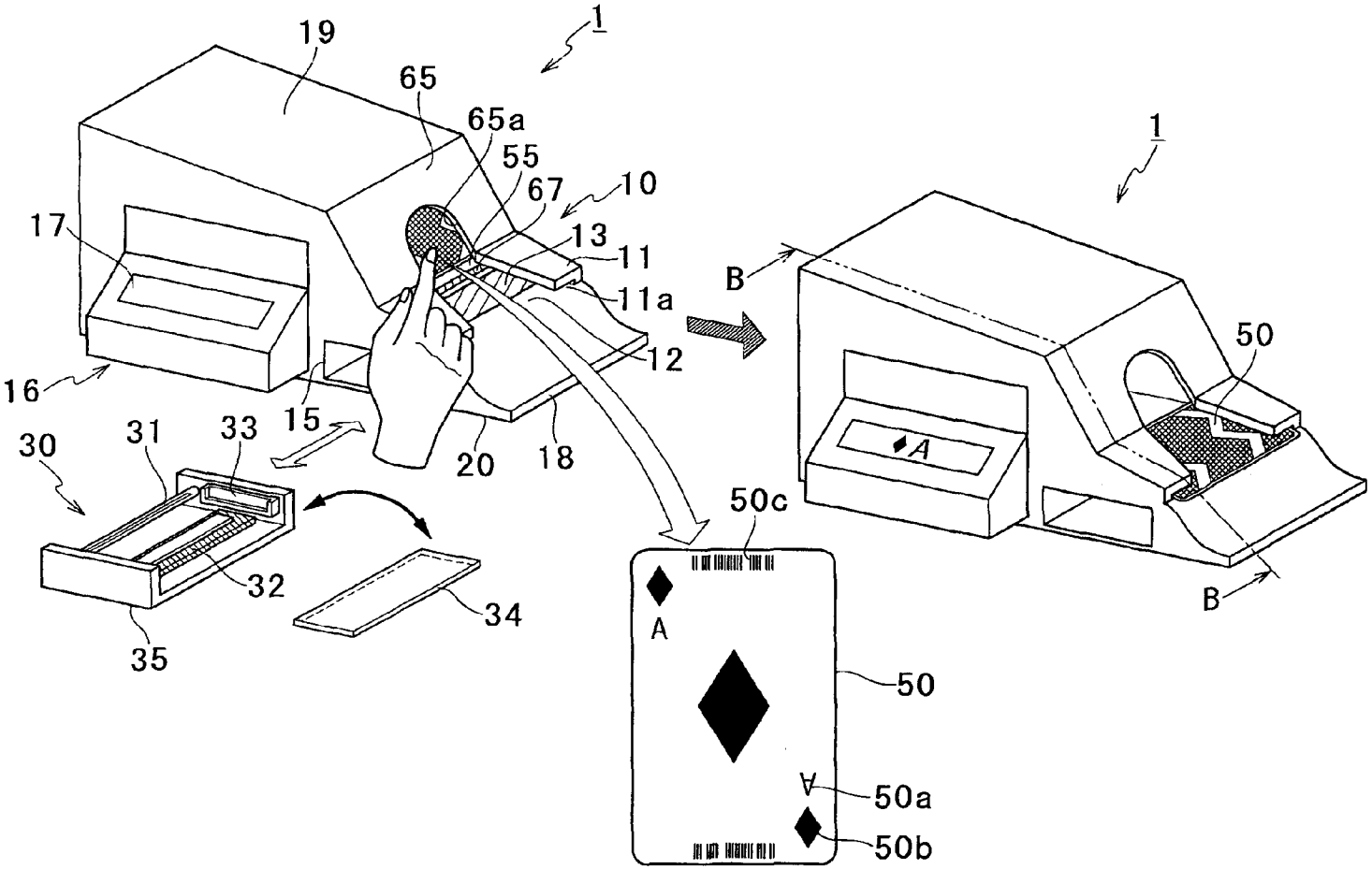
FIG. 8 illustrates a card shoe apparatus of Second Embodiment according to the present invention.
Figure 9:
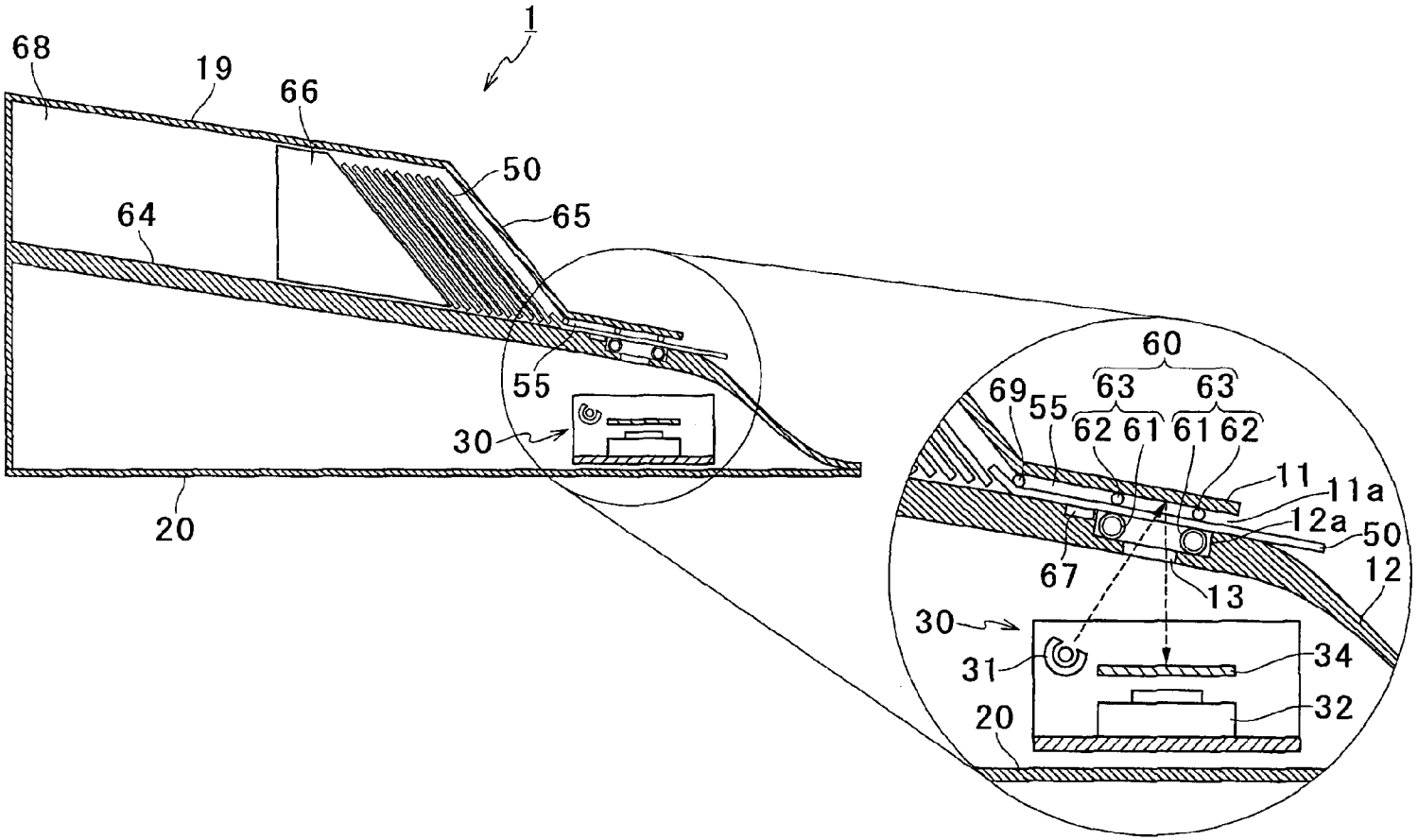
FIG. 9 is a cross section taken along the B-B line in FIG. 8.

FIG. 8 illustrates a card shoe apparatus according to Second Embodiment. FIG. 9 is a cross section taken at the B-B line in FIG. 8.

As shown in FIG. 8 and FIG. 9, the card shoe apparatus 1 includes a cover portion 19, a bottom portion 20, a storage unit 68 storing a card 50, a guide path 10 by which the card 50 drawn from the storage unit 68 is guided from a card drawing outlet 55 to a card discharging edge 18, a detector unit 30, a moving unit 60, and a display unit 16. The cover portion 19 is attached to the bottom portion 20 to cover a control board 150 and the storage unit 2.

The bottom part 64 of the storage unit 68 is, as shown in FIG. 9, an inclined plane inclining downward toward the card drawing outlet 55. In the storage unit 68,cards 50 stored in the storage unit 68 are pushed toward the card drawing outlet 55 onto a front wall 65, by a trapezoidal card pushing member 66. The cards 50 are stored in the storage unit 68 such that one of the edges of each card on the short sides contacts the bottom part 64 and each card 50 is face down. At the short sides of each card 50, barcodes 50*c* are printed. The barcode 50*c* is code information indicating card information.

The front wall 65 of the storage unit 68 is provided with a drawing window 65*a* to allow the dealer to draw, through the drawing window 65*a*, a single card 50 from the storage unit 68 to the card drawing outlet 55.

The card drawing outlet 55 has a card sensor 67 and a guide roller 69 which guides a card 50 to the guide path 10. The card sensor 67 detects whether a card 50 exists at the card drawing outlet 55.

In the guide path 10 is provided the moving unit 60 which moves a card 50. The moving unit 60 has plural roller pairs 63 each consisting of a drive roller 61 rotated by the actuator driving unit 156 and a driven roller 62 which is rotatable.

The drive rollers 61 are provided in a groove 12*a* formed on the card guide surface 12, and are rotated by the actuator driving unit 156. The driven rollers 62 are provided in the guide groove 11*a* of the guide rail 11. The widths of the drive rollers 61 and the driven rollers 62 are arranged to be slightly shorter than the depth of the guide groove 11*a* of the guide rail 11.

A card 50 is moved in the guide path 10 from the card drawing outlet 55 toward the card discharging edge 18 while being pinched by the drive rollers 61 and the driven rollers 62.

The rotation speed of each drive roller 61 is controlled by the actuator driving unit 156 such that the traveling speed of a card 50 is constant and allows the control unit 151 to identify the card information.

(Electric Configuration of Card Shoe Apparatus 1)

Figure 10:
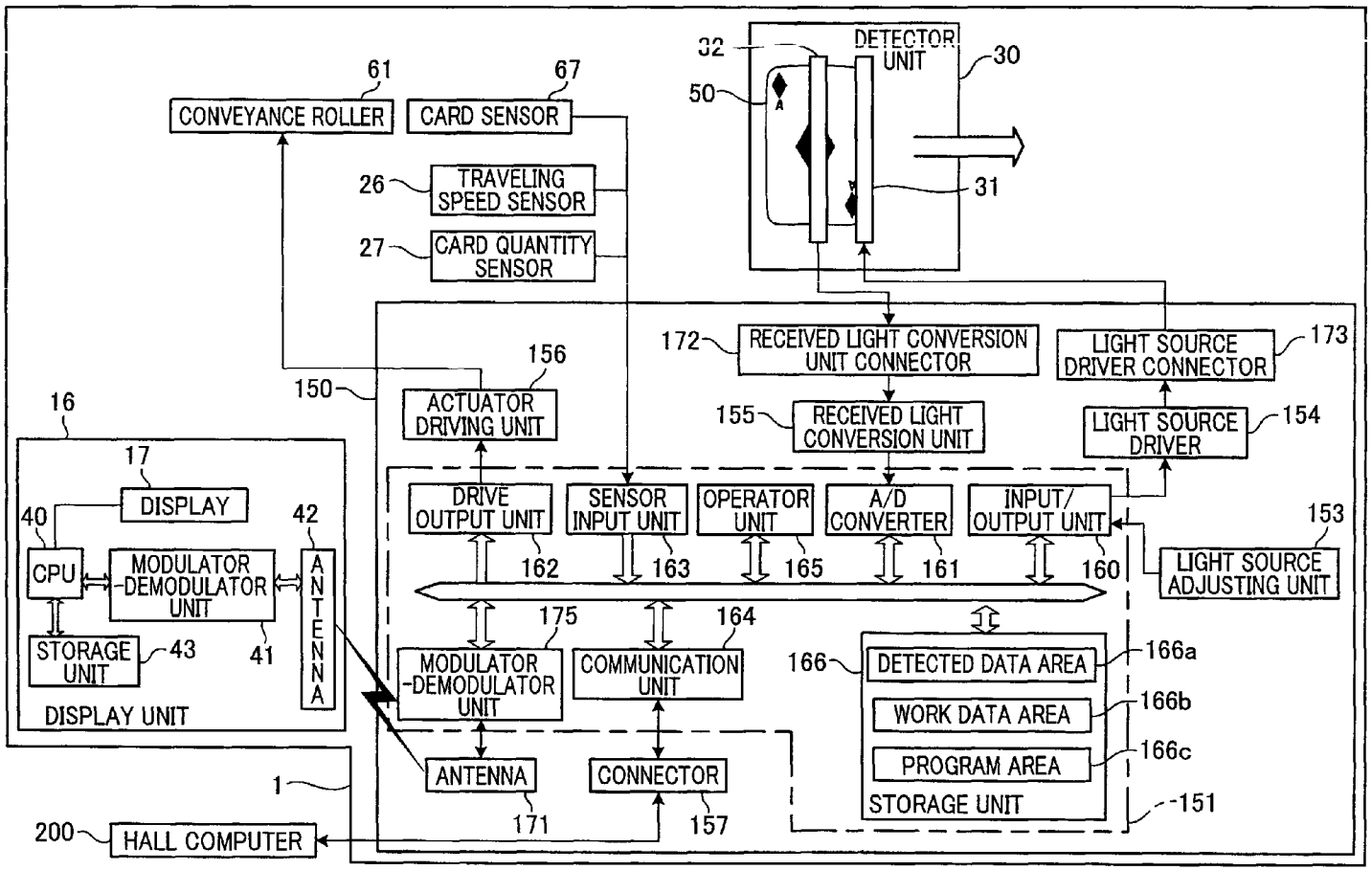
FIG. 10 shows an electric configuration of the card shoe apparatus of Second Embodiment according to the present invention.

Now, the electric configuration of the card shoe apparatus 1 according to Second Embodiment will be described with reference to FIG. 10.

The sensor input unit 163 is connected to the traveling speed sensor 26 and the card sensor 67, and allows signals from these sensors to be converted to have formats suitable for information processing in the control unit 151 and to be fetched. The drive output unit 162 is connected to the actuator driving unit 156, and rotates the drive rollers 61 by means of the actuator driving unit 155 when the card sensor 67 detects the existence of a card 50 at the card drawing outlet 55.

The light source driver 154 drives the inspection light applicator 31 to output infrared linear light, when the card sensor 67 detects that a card 50 exists at the card drawing outlet 55.

A program area 166*c* of the storage unit 166 stores, in readable and rewritable manners, various programs such as a identification process routine, templates of card information, and various types of data such as a code table in which card information is associated with code information of a barcode.

(Operation of Card Shoe Apparatus 1)

Now, the operation of the card shoe apparatus 1 will be described. First, when the dealer draws out a single card 50 from the storage unit 68 to the card drawing outlet 55 by the drawing window 65*a* of the front wall 65, the card sensor 67 detects that the card 50 exists at the card drawing outlet 55. When the card sensor 67 detects the existence of a card 50, the light source driver 154 drives the inspection light applicator 31 to cause the inspection light applicator 31 to output infrared linear light towards the opening 13. The drive output unit 162 rotates the drive rollers 61 by the actuator driving unit 155 to move a card 50 at the card drawing outlet 55 in the guide path 10 at a constant speed which allows the control unit 151 to identify the card information.

The infrared linear light output from the inspection light applicator 31 passes through the opening 13 and is projected to the card 50 moving in the guide path 10 so that the card 50 is scanned by the light along its long sides. The infrared linear light reflected from the card 50 passes through the opening 13 and is received via the filter 34 by pixels aligned to form rows on the photo acceptance portion 32.

The intensity of the light reflected from the card 50, which light has been received by each pixel of the photo acceptance portion 32, is converted to an analog electric signal by the received light conversion unit 155, in each predetermined time. The analog values each for one line and having been converted within each predetermined time are serially output to the A/D converter 161 along the long sides of the card 50.

An analog value for one line, which has been output from the received light conversion unit 155, is converted to digital data by the A/D converter 161, and is temporarily stored as detected data for one line in a detected data area 166*a* of the storage unit 166.

The detected data temporarily stored in the detected data area 166*a* is transferred to the work data area 166*b*, and the card information of this detected data is identified by the operator unit 165.

A card information signal representing the card information identified by the operator unit 165 is output to the hall computer 200 and the display unit 16. The display 17 of the display unit 16 displays the card information represented by the received card information signal.

As described above, the card shoe apparatus 1 according to Second Embodiment is arranged so that a card 50 stored in the storage unit 68 is manually drawn to the card drawing outlet 55. Since it is unnecessary to provide in the card shoe apparatus 1 a conveyance mechanism or the like for conveying a card 50 from the storage unit 68 to the card drawing outlet 55, the card shoe apparatus 1 is downsized.

(Main Process Routine)

Figure 11:
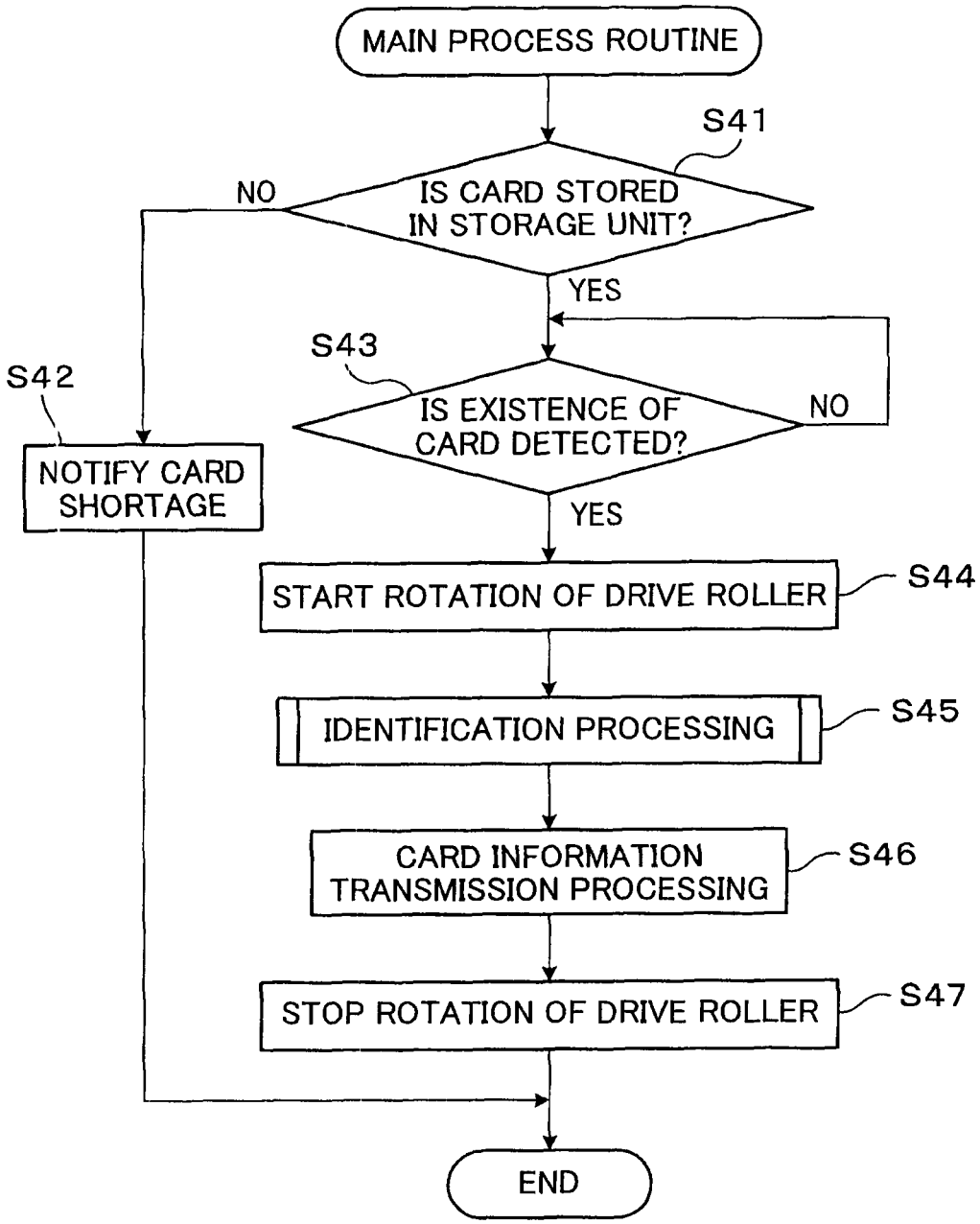
FIG. 11 is a flowchart of a main process routine of Second Embodiment according to the present invention.

Now, the main process routine of the card shoe apparatus 1 according to Second Embodiment will be described. FIG. 11 is a flowchart of the main process routine of the card shoe apparatus 1 according to Second Embodiment.

First, the control unit 151 determines whether at least a predetermined number of cards are stored in the storage unit 2, by the card quantity sensor 27 (S41). If it is determined that at least the predetermined number of cards are not stored (S41: NO), a card refill signal is output to the display unit 16 and the hall computer 200 to notify the dealer and the hall administrator that at least the predetermined number of cards 50 are not stored (S42), and the process routine is finished.

On the other hand, if it is determined that at least a predetermined number of cards are stored (S41: YES), the control unit 151 determines whether a card 50 exists at the card drawing outlet 55 (S43). If it is determined that no card 50 exists at the card drawing outlet 55 (S43: NO), the process proceeds to S43. On the other hand, if it is determined that a card 50 exists at the card drawing outlet 55 (S43: NO), the rotation of the drive rollers 61 starts (S44). The rotation speed of the drive rollers 61 is controlled by the actuator driving unit 156 so that the card 50 moves in the guide path 10 at a constant speed which allows the control unit 151 to identify the card information. Thereafter, the control unit 151 carries out identification processing which will be described later with reference to FIG. 12 (S45).

Subsequently, the control unit 151 carries out card information transmission processing to output, to the display unit 16 and the hall computer 200, a card information signal representing the card information of the card 50 identified in the identification processing in S45 (S46). If in S45 a later-described unidentifiable signal has been output to the display unit 16 and the hall computer 200, S46 is not carried out.

Thereafter, the rotation of the drive rollers 61 is stopped (S47) and the process routine is finished.

(Identification Process Routine)

Figure 12:
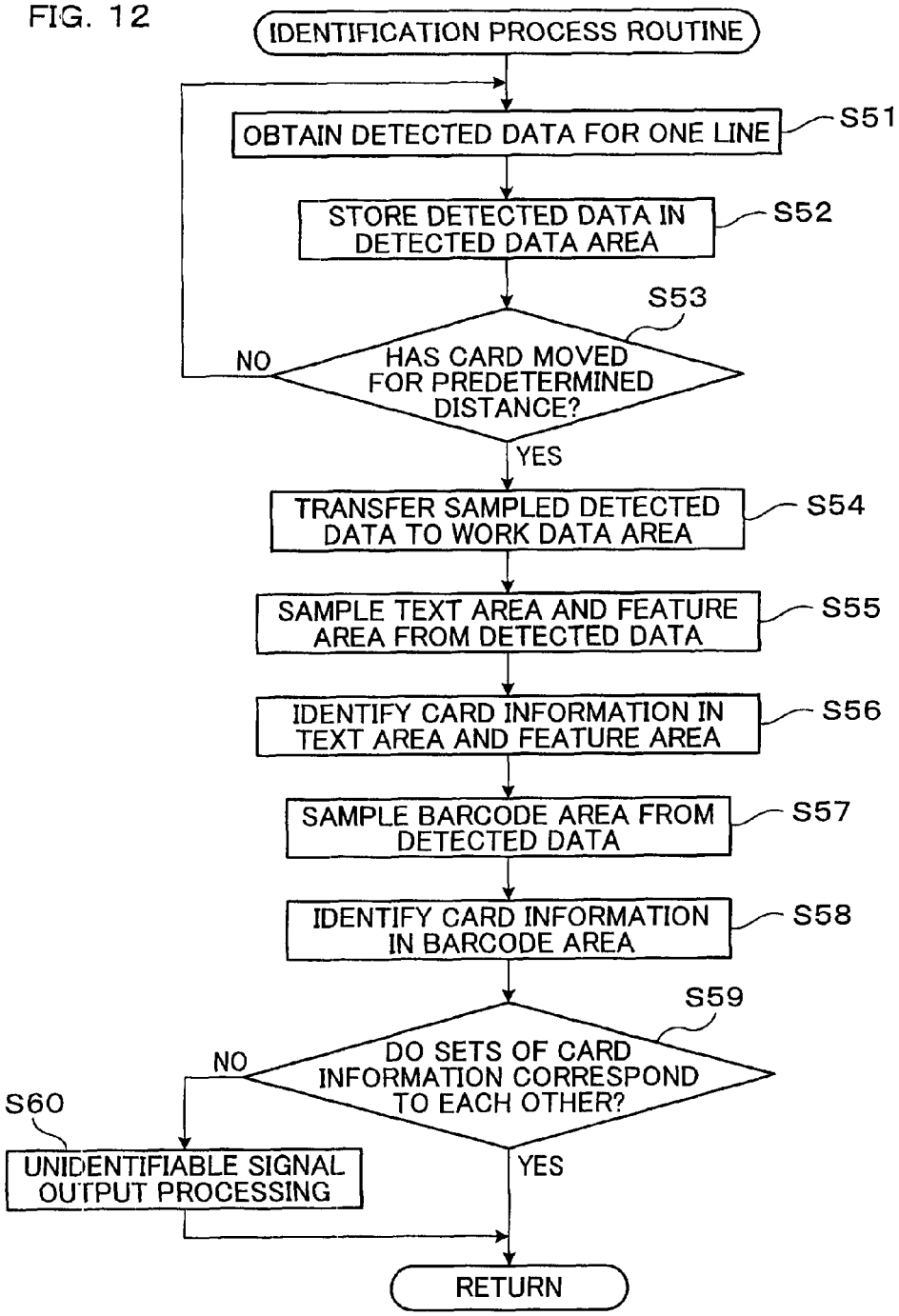
FIG. 12 is a flowchart of an identification process routine of Second Embodiment according to the present invention.

An identification process routine of the card shoe apparatus 1 according to Second Embodiment will be described. FIG. 12 is a flowchart of the identification process routine of the card shoe apparatus 1 according to Second Embodiment.

First, the control unit 151 obtains detected data for one line (S51) and stores this detected data in the detected data area 166*a* (S52). Subsequently, the control unit 151 determines whether the card 50 has moved for a predetermined distance in the guide path 10, by the traveling speed sensor 26 (S53). If it is determined that the card 50 has not moved for the predetermined distance (S53: NO), the process goes back to S51. On the other hand, if it is determined that the card 50 has moved for the predetermined distance (S53: YES), the detected data stored in the detected data area 166*a* is transferred to the work data area 166*b* (S54).

Subsequently, the control unit 151 samples a text area and a symbol area from the detected data (S55), and identifies the card information in the text area and the symbol area (S56).

Thereafter, the control unit 151 samples a barcode area from the detected data (S57), recognizes the code information of a barcode 50*c* in the sampled barcode area, and identifies the card information represented by the recognized code information with reference to a code table stored in the program area 166*c* of the storage unit 166 (S58).

Thereafter, the control unit 151 determines whether the card information identified in S56 corresponds to the card information identified in S58 (S59). If the sets of information correspond to each other (S59: YES), the process routine is terminated. On the other hand, if it is determined that the sets of information do not correspond to each other, unidentifiable signal output processing is carried out to output an unidentifiable signal indicating that the card information was not identified to the display unit 16 and the hall computer 200 (S60), and the process routine is terminated. When the unidentifiable signals are input to the display unit 16 and the hall computer 200, the display unit 16 and the hall computer 20C notify the dealer and the hall administrator that the card information was not identified.

As such, Second Embodiment is arranged such that, only when the card information identified by means of a text area and a symbol area of the detected data corresponds to the card information identified by means of a barcode area of the detected data, the card shoe apparatus 1 outputs the card information to the display unit 16 and the hall computer 200. This improves the accuracy of the identification of card information output to the display unit 16 and the hall computer 200.

(Outline of Second Embodiment)

As described above, a card shoe apparatus 1 according to Second. Embodiment includes a storage unit 68 storing cards 50, a guide path 10 which guides a card 50 drawn out from the storage unit 2 to a card discharging edge 18 with one surface of the card kept contacting the guide path 10, an opening 13 formed in the guide path 10, an inspection light applicator 31 which applies inspection light to the drawn card 50 via the opening 13, a photo acceptance portion 32 which receives inspection light reflected from the drawn card 50, a control unit 151 which identifies the card information based on the inspection light received by the photo acceptance portion 32, a filter 34 which is provided between the opening 13 and the photo acceptance portion 32 to block disturbance light, and a moving unit 60 which moves the drawn card 50 in the guide path 10 at a speed allowing the control unit 151 to identify the card information.

In the above-described arrangement, the filter 34 is provided between the opening 13 and the photo acceptance portion 32 to block disturbance light. Since the photo acceptance portion 32 receives only inspection light reflected from a drawn card 50 without being influenced by disturbance light, the card information is accurately identified. Furthermore, since the moving speed of the drawn card 50 in the opening 13 allows the control unit 151 to identify the card information, it is possible to accurately identify the card information.

In the card shoe apparatus 1 of Second Embodiment, the moving unit 60 moves a drawn card 50 at a constant speed in the guide path 10. This makes it possible to restrain the accuracy of identification of the card information from being lowered on account of a change in the traveling speed of the drawn card 50 in the guide path 10.

While the present invention has been described in conjunction with Second Embodiment outlined above, it is evident that many alternatives, modifications and variations will be apparent to those skilled in the art. Accordingly, the effects of Second Embodiment of the invention as set forth above are merely listed as most favorable effects of the invention, and hence the effects of the invention are not limited to those in Second Embodiment.

For example, the card shoe apparatus 1 according to Second Embodiment is arranged so that the code information of the barcode 50*c* is recognized by detecting the infrared linear light reflected from the card 50. The present invention, however, is not limited to this arrangement. An alternative arrangement may be made such that a barcode 50*c* is printed on a card 50 by a ultraviolet color ink which develops a color in response to ultraviolet light, and an ultraviolet light lamp which applies ultraviolet light to a barcode 50*c* of a card 50 moving in the guide path 10 and an ultraviolet light acceptance portion which receives ultraviolet light reflected from the card 50, which are provided in the detector unit 30, make it possible to recognize the code information of the barcode 50*c*.

What is claimed is:

1. A card shoe apparatus comprising:

a storage unit which stores a card;

a guide path including a conveyance end edge, a card guide surface and a card discharge edge, the guide path configured to guide the card drawn out from the storage unit to the card discharging edge while keeping one surface of the card in contact the guide path;

an opening formed in the guide surface proximate the conveyance end edge;

an inspection light applicator which applies inspection light to the drawn card via the opening;

a photo acceptance portion disposed across from the opening and which receives the inspection light reflected from the drawn card;

a card information identification unit which identifies card information based on the inspection light received by the photo acceptance portion; and a filter which is provided between the opening and the photo acceptance portion to block the disturbance light, wherein the inspection light applicator is disposed proximate the photo acceptance portion and includes a cover member having a slit extending along a length thereof, the slit configured to direct inspection light toward the drawn card via the opening and to prevent the inspection light from being directed directly from the inspection light applicator and toward the photo acceptance portion.

2. The card shoe apparatus according to claim 1, wherein, the filter is arranged to be detachable.

3. The card shoe apparatus according to claim 1, further comprising:

a moving unit which moves the drawn card in the guide path at a speed which allows the card information identification unit to identify the card information.

4. The card shoe apparatus according to claim 3, wherein, the moving unit moves the drawn card at a constant speed in the guide path.

* * * * *